US005674141A

United States Patent [19]

Laforest

[11] Patent Number: 5,674,141

[45] Date of Patent: Oct. 7, 1997

[54] BROOMBALL BROOM

[75] Inventor: Pierre Laforest, Bathurst, Canada

[73] Assignee: Forest-Ice, Bathurst, Canada

[21] Appl. No.: 736,343

[22] Filed: Oct. 23, 1996

[51] Int. Cl.[6] ..... A63B 59/14

[52] U.S. Cl. ..... 473/559

[58] Field of Search ..... 473/558, 560, 473/562, 563, 559; 273/67 R; D21/210

[56] References Cited

U.S. PATENT DOCUMENTS

| | | | |
|---|---|---|---|
| D. 276,063 | 10/1984 | Gervais | D21/210 |
| 3,671,038 | 6/1972 | Liard | 473/558 |
| 3,720,410 | 3/1973 | Saytar | 473/562 |
| 4,222,562 | 9/1980 | Gardner | 273/67 R |
| 4,664,379 | 5/1987 | Melby . | |
| 4,799,682 | 1/1989 | Hughes . | |
| 5,306,003 | 4/1994 | Pagotto | 473/560 |
| 5,511,776 | 4/1996 | Huru | 473/563 |

FOREIGN PATENT DOCUMENTS

| | | |
|---|---|---|
| 706285 | 3/1965 | Canada . |

*Primary Examiner*—Mark S. Graham
*Attorney, Agent, or Firm*—Paul Sharpe

[57] ABSTRACT

There is disclosed a broomball broom head, comprising a molded solid body having opposed faces with edges, a top end and a bottom end spaced therefrom, at least one of the opposed faces having a concave area spaced inwardly from the edges and the lower end, the top end having a stick receiving opening being confined to the top end.

11 Claims, 3 Drawing Sheets

BROOMBALL BROOM

FIELD OF THE INVENTION

The present invention relates to a broomball head and more particularly, the present invention relates to a molded broomball head having at least one concave portion in the face of the broomball head.

BACKGROUND OF THE INVENTION

Various forms of broom heads or brooms for use in the game have been proposed in the art. Typical of the representations of this article is illustrated in U.S. Pat. No. 4,222,562, issued to Gardner, Sep. 16, 1980. In the Gardner reference, a molded broom head is provided being composed of an elastomeric material. The use of the material is quite advantageous, however, in the Gardner arrangement, the broomball stick extends substantially through the entire body of the broomball head and as a result, the body is slightly bulged outwardly when viewed in profile on both sides and tapers generally to the bottom of the broom. Another problem with this arrangement is that since the stick extends essentially entirely through the body, ball management and control is difficult. The presence of the stick provides a very rigid surface upon which the ball, when the same strikes the face of a broom, can bounce away from the player. Further, it is believed the arrangement interferes with the momentum transfer from the head to the ball. Another disadvantage associated with the arrangement shown by Garner relates to the fact that the stick is more easily broken. Much of the contact force or the swinging or impact force realized by the broom is directly transmitted to the lower end of the stick. Accordingly, if a player were to strike the ball and miss and inadvertently hit the ground, the likelihood of breakage of the stick is high.

Liard in U.S. Pat. No. 3,671,038, issued Jun. 20, 1972 discloses a stick for an ice ball game in which the stick has a straight handle and the broom head includes a shovel-like cavity on both sides thereof. The arrangement disclosed in this patent provides a two piece unit which must be fastened to the stick via fasteners. Such an arrangement, although generally useful, poses a potential danger in that of the fasteners were to become loose by the continued use of the stick, disengagement of the faces from the stick could result, posing a danger to the other players. This is particularly true since the stick is often swung at high velocity and generally above the waist or overhead.

U.S. Pat. No. 3,720,410, issued Mar. 13, 1973, to Saytar provides a ball hockey stick with curvilinear striking faces. The patentee has provided a blade which is composed of a rigid plastic having two opposing concave sections which are of a circular nature and terminate in a generally straight portion therefore providing a claveat-shaped head. This article is specifically designed for use in ball hockey and not appear to have any degree of utility in the game of broomball.

Other U.S. patents related to this subject matter include U.S. Pat. Nos. 1,414,124; 4,664,379; 4,799,682; as well as Canadian Patent No. 706,285.

In view of what the prior art has proposed, it is clear that there is a need for a well balanced molded broomball broom head which facilitates more accurate ball handling for the user. The present invention is directed to satisfying this need.

SUMMARY OF THE INVENTION

One object of the present invention is to provide a significantly improve a broomball broomhead.

A further object of the present invention is to provide a broomball broom head, comprising:

a molded solid body having opposed faces with edges, a top end and a bottom end spaced therefrom, at least one of the opposed faces having a concave area spaced inwardly from the edges and the lower end, the top end having a stick receiving opening being confined to the top end.

By providing the concave surfaces in the blade head, it has been found that it is easier to manipulate the ball with the broom since the concavity tends to maintain a ball in the centre region of the broom head. Such an arrangement is also useful in developing players skills with respect to handling methods for the ball, e.g. scooping, wrist shots, slap shots, etc.

A further advantage with the present broomball head is that the same can be made from a high performance thermoplastic elastomer. Utility for this type of material is clear. The material lends itself well to molding, high wearability and does not require any type of fasteners to integrate the head to the stick. Thermoplastic resins can be selected to maximize the level of contact friction with the ball and can be textured to enhance the frictional engagement.

A still further object the present invention is to provide a broomball broom, comprising:

a molded solid body having opposed faces with edges, a top end and a lower end spaced therefrom, one of the opposed faces having a concave area spaced inwardly from the edges and the lower end, the top end having a stick receiving opening for receiving a stick, the stick receiving opening being confined to the top end of the body; and a stick engaged with the body, the stick having a tapered body for indicating to a user the opposed face having the concave area.

As indicated herein briefly, one of the problems with existing broomball sticks is that the same are manufactured with the stick extending substantially through the entire length of the broomball broom head and the result of this is that the body generally bulges about the stick and tapers at the edges to present a surface upon which the ball, when the same comes in contact with the bulge, bounces away from the broomball head thereby complicating control for the user. In addition, the fact that the stick is substantially in striking contact with the ball on a continuous basis, the likelihood of breakage of the stick is substantially increased.

With the present arrangement, since the stick is only positioned towards the top of the body, the result is that the stick is not in the strike zone on a perpetual basis. This allows a greater amount of thermoplastic material to fill the void that would otherwise be occupied by the stick, thus increasing the weight of the head and therefore the centre of mass of the broomball stick. The centre of mass is further augmented by the fact that the stick may be shaved from the top downwardly so that the mass of the stick is concentrated towards the broomball head. This arrangement clearly has an advantage in that the mass is concentrated at the precise area which the ball will be in contact with and therefore assists in impact force presented to the ball. As a further advantage to the arrangement, the concavity assists in manipulation of the ball since no outwardly projecting surface is presented thereby assisting in ball control for the user.

Having thus generally described the invention, reference will now be made to the accompanying drawings illustrating preferred embodiments.

BRIEF DESCRIPTION OF THE DRAWINGS

Similar numerals in the figures denote similar elements.

DETAILED DESCRIPTION OF THE PREFERRED EMBODIMENTS

Figure 1:
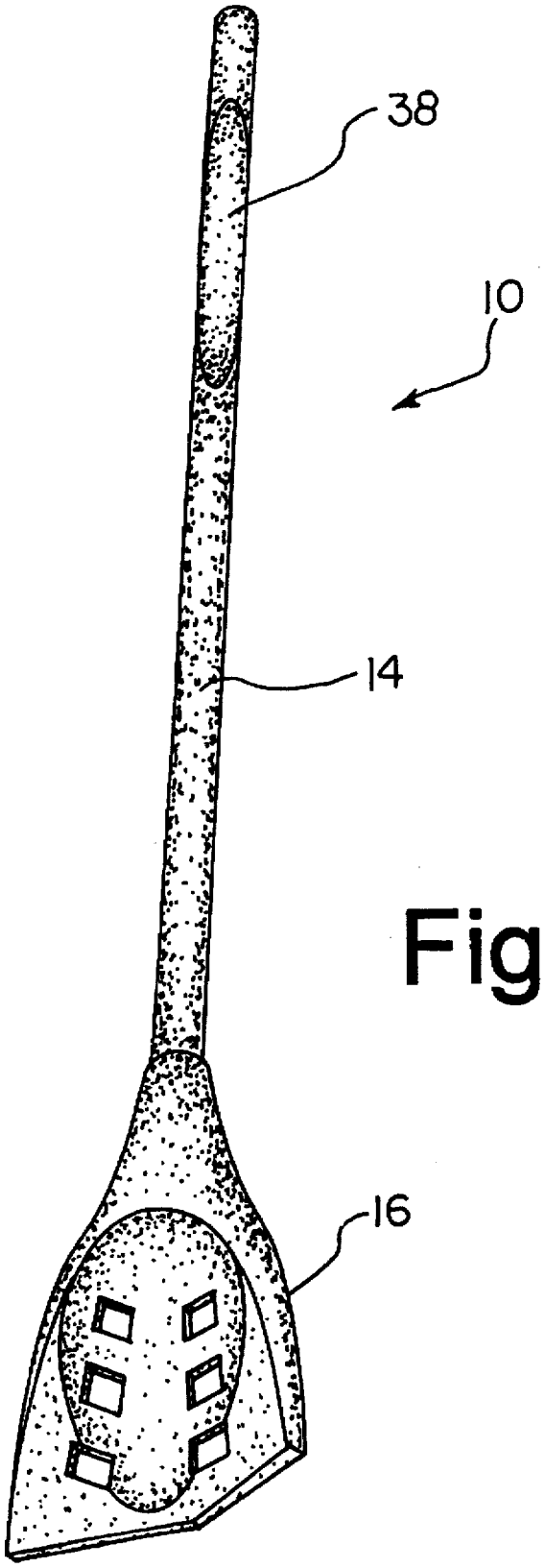
FIG. 1 is an overall perspective view of the broom according to one embodiment of the present invention.

Referring now to the drawings, FIG. 1 illustrates an overall perspective view of the broomball broom, globally denoted by numeral 10, including a broomball stick 14 and a broomball broom head 16.

Figure 2:
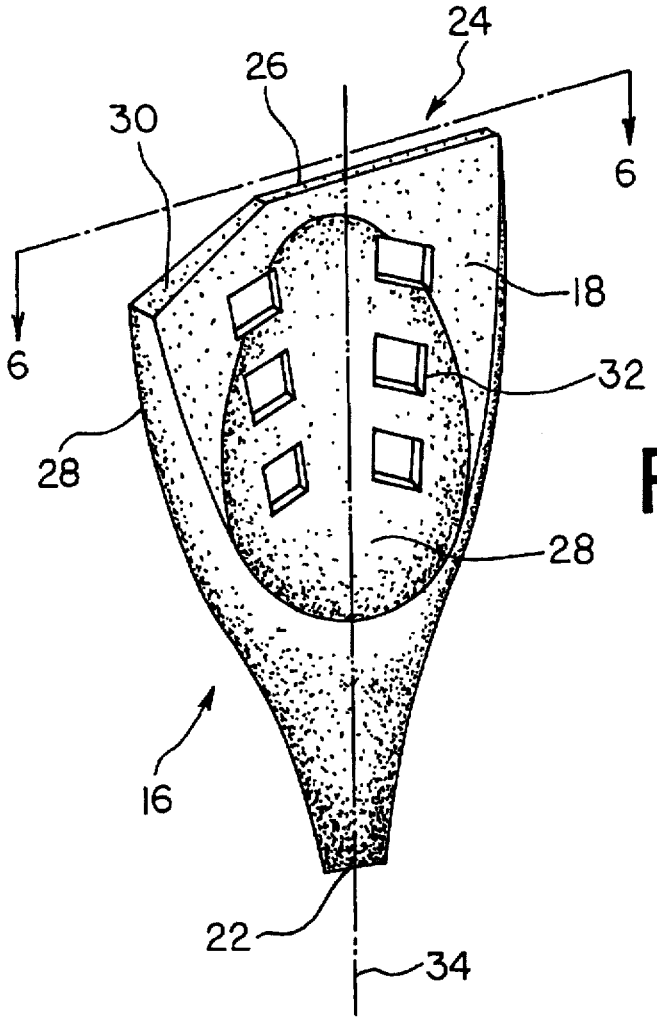
FIG. 2 is an enlarged perspective view of the broomball broom head.
Figure 3:
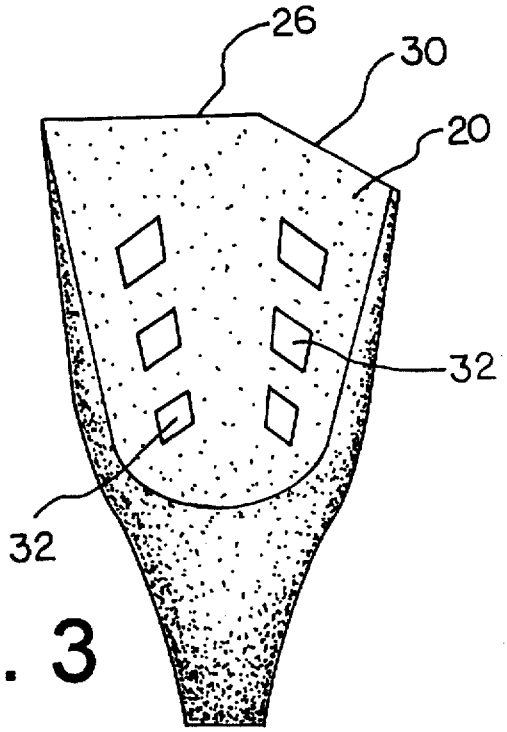
FIG. 3 is a front elevational view of an opposed side of the broom shown in FIG. 2.
Figure 4:
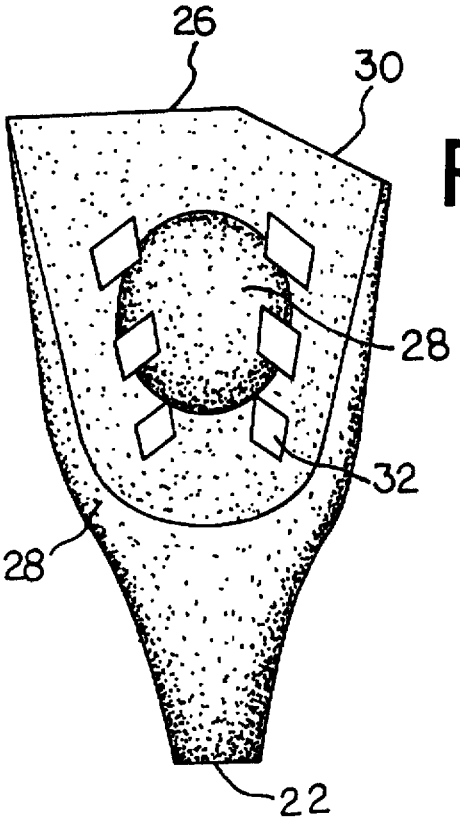
FIG. 4 is a front elevational view of an alternate embodiment.
Figure 6:
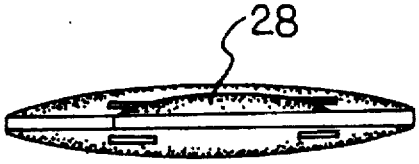
FIG. 6 is a view along line 6—6 of FIG. 1.
Figure 5:
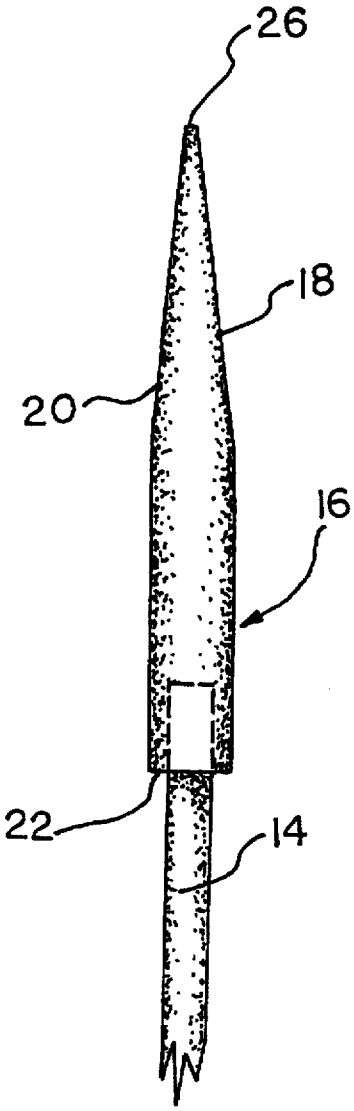
FIG. 5 is an end elevational view.

In greater detail with respect to head 16, FIGS. 2 and 3 show head 16 standing alone, FIG. 2 showing one face and FIG. 3 showing the opposite face. Head 16 includes opposed faces 18 and 20, the head including a stick receiving portion 22 in the body, discussed hereinafter in greater detail and a lower end 24. The head 16 includes a lower edge 26 and edging 28 surrounding the remaining portion of the body. In the example shown in FIG. 2, there is a concave area 28 exposed within face 18 such that the concave area 28 is spaced inwardly edging 28 and 26. Concave area 28, shown in FIG. 2, subscribes to a general ellipsoidal shape. It will be appreciated that various different shapes can constitute the concave area, an example of which is a generally circular area as shown in FIG. 4, an alternate embodiment of FIG. 2. Other suitable arrangements will be readily appreciated by those skilled in the art. The body 16 is preferably a molded material and may be selected from suitable thermoplastic elastomers or other related compounds. An optional feature is to provide a cut corner 30 on body. 16 in order to assist in better handling of the broomball broom. As illustrated in FIG. 2, the broom head 16 includes a plurality of apertures 32 which extend completely through the body of the head 16. Further, the apertures 32 have counterparts about a longitudinal axis, shown in dashed lines and represented by numeral 34. The apertures 32 on one side of the longitudinal axis 34 to the other are mere images of one another. It has been found that the apertures 32, due to the disposition thereof, concentrate the centre of mass of head 16 in the concave area 28. This is desirable since the concave area effectively is the "sweet spot" for the point of maximum efficiency for striking the ball where there is no real torque presented to head 16 and thus to the handle 14 of the broom 10. By providing concave area 28, the result is that there is no bulging surface presented by the head 16. This is shown more clearly in FIG. 6, which shows an underside view of the head 16. As is illustrated, the overall shape of the head 16 is generally of an ellipse being thin at the centre. This is in marked contrast to the existing arrangements in the art in that the overall ellipsoidal profile of the head 16 together with the fact that the concave portion 28 is present, provides a surface which is adapted to accept a ball (not shown) rather than a "bulging" surface typically encountered by those arrangements in the prior art. The concavity associated with the head is complimented by the stick receiving portion 22 of the head 16. This is shown generally in FIG. 5 where the stick 14 is shown as disposed within head 16. As is illustrated, the stick 14 is only received generally at the top portion of the head 16 to therefore leave the head 16 as an integral unit unencumbered by stick 14 extending through the body. The result of this is that more material can be employed in the head 16 therefore concentrate its mass while at the same time providing an inherently better broom 10 since stick 14 is only contacting head 16 at a point. A further advantage attributed to this arrangement can be realized in that substantially all of the weight of the broom 10 is concentrated at the head portion 16 thus resulting in a more effective arrangement to transfer energy from the swing of the player to the ball (the latter not being shown).

In the instance where the head 16 includes only one face either 18 or 20 having the concavity 28, stick 14 may be provided with a shaved area 38, as illustrated in FIG. 1, to indicate to the user that the concavity is associated with that side of the stick. The shaved portion 38 may comprise any other indication means, e.g. a textured surface or other gripping means to serve as indication. As a variation both sides of the stick 14 may comprise a non-circular surface for enhanced stick control and to indicate to a player where the faces 18 or 20 are located.

Although embodiments of the invention have been described above, it is not limited thereto and it will be apparent to those skilled in the art that numerous modifications form part of the present invention insofar as they do not depart from the spirit, nature and scope of the claimed and described invention.

I claim:

1. A broomball broom head, comprising:

a molded solid body having opposed faces with edges, a top end and a bottom end spaced therefrom, at least one of said opposed faces having a substantially circular concave area spaced inwardly from said edges and said lower end, said top end having a stick receiving opening being confined to said top end.

2. The broomball broom head as defined in claim 1, wherein both said opposed faces have a concave area.

3. The broomball broom head as defined in claim 1, wherein said solid body includes apertures extending therethrough.

4. The broomball broom head as defined in claim 3, wherein said body comprises a thermoplastic elastomer.

5. The broomball broom head as defined in claim 1, wherein said body includes at least one cut corner.

6. A broomball broom, comprising:

a molded solid body broom head having opposed faces with edges, a top end and a lower end spaced therefrom, one of said opposed faces having a substantially circular concave area spaced inwardly from said edges and said lower end, said top end having a stick receiving opening for receiving a stick, said stick receiving opening being confined to said top end of said body; and a stick engaged with said body, said stick having a tapered body for indicating to a user the opposed face having the concave area.

7. The broomball broom as defined in claim 6, wherein said broom has a centre of mass directed toward said broom head.

8. The broomball broom as defined in claim 7, wherein said head includes apertures therethrough.

9. The broomball broom as defined in claim 8, wherein said apertures are positioned adjacent said edges for concentrating the mass of said body at said concave portion.

10. The broomball broom as defined in claim 9, wherein said apertures are in mirror image about a longitudinal axis of said broomball head.

11. A broomball broom head, comprising:

a molded solid body having opposed faces with edges, a top end and a bottom end spaced therefrom, at least one of said opposed faces having a substantially ellipsoidal concave area spaced inwardly from said edges and said lower end, said top end having a stick receiving opening being confined to said top end.

* * * * *